US009822492B2

(12) United States Patent
Hartl et al.

(10) Patent No.: US 9,822,492 B2
(45) Date of Patent: Nov. 21, 2017

(54) METHOD AND DEVICE FOR LATERAL COPYING OF A RAIL

(71) Applicant: Vossloh MFL Rail Milling GmbH, Liezen (AT)

(72) Inventors: Erich Hartl, Laakirchen (AT); Wolfgang Neuhold, Gmunden (AT)

(73) Assignee: Vossloh MFL Rail Milling GmbH, Liezen (AT)

( * ) Notice: Subject to any disclaimer, the term of this patent is extended or adjusted under 35 U.S.C. 154(b) by 57 days.

(21) Appl. No.: 14/426,505

(22) PCT Filed: Aug. 30, 2013

(86) PCT No.: PCT/AT2013/000140
§ 371 (c)(1),
(2) Date: Mar. 6, 2015

(87) PCT Pub. No.: WO2014/040094
PCT Pub. Date: Mar. 20, 2014

(65) Prior Publication Data

US 2015/0233064 A1 Aug. 20, 2015

(30) Foreign Application Priority Data

Sep. 12, 2012 (AT) ..... A 994/2012

(51) Int. Cl.
*E01B 31/12* (2006.01)

(52) U.S. Cl.
CPC ..... *E01B 31/12* (2013.01)

(58) Field of Classification Search
CPC ..... E01B 29/00; E01B 29/02; E01B 31/00; E01B 31/02; E01B 31/04; E01B 31/06; E01B 31/08; E01B 31/12; E01B 31/13; E01B 31/15; E01B 31/17
See application file for complete search history.

(56) References Cited

U.S. PATENT DOCUMENTS

| | | | |
|---|---|---|---|
| 4,534,689 | A | 8/1985 | Theurer |
| 4,951,424 | A | 8/1990 | Buhler |
| 2013/0318762 | A1 | 12/2013 | Knoll |

FOREIGN PATENT DOCUMENTS

| | | | |
|---|---|---|---|
| AT | 366 437 | | 8/1981 |
| AT | 510 566 | A4 | 5/2012 |
| DE | 30 15 230 | A1 | 3/1981 |
| DE | 275 837 | A5 | 2/1990 |
| DE | 283 850 | A5 | 10/1990 |

(Continued)

*Primary Examiner* — Robert J McCarry, Jr.
(74) *Attorney, Agent, or Firm* — Muirhead and Saturnelli, LLC

(57) ABSTRACT

The method according to the invention and a device suitable therefor are used for controlling various device units on a rail vehicle by means of lateral copying. By additionally using available information from the track channel (12), for example, of check rails (30) or wing or switch rails (31, 33), device units for machining and/or analyzing laid tracks (10) can more precisely follow the actual rail profile, in particular in the region of rail gaps or railroad crossings. The lateral copying of the rails (10) and the copying of the rest of the track channel (12) takes place with at least one dual-action or a plurality of single-action or dual-action scanning or sensor units (20).

24 Claims, 3 Drawing Sheets

(56) References Cited

FOREIGN PATENT DOCUMENTS

| | | | | | |
|---|---|---|---|---|---|
| DE | 10 2009 007 568 | A1 | | 8/2010 | |
| EP | 0 552 473 | A1 | | 7/1993 | |
| EP | 0552473 | | * | 7/1993 | ..... E01B 31/12 |
| EP | 0 952 255 | A1 | | 10/1999 | |
| EP | 1 415 885 | A1 | | 5/2004 | |

* cited by examiner

METHOD AND DEVICE FOR LATERAL COPYING OF A RAIL

TECHNICAL FIELD

This application relates to a method and a device for the controlled lateral copying unit of a device unit for analysis, material removal, or material application to laid rails. In particular, the method and the device are used for tracking the device unit in the case of rail gaps to be traveled over, for example, rail butt joints, shunt and intersection subregions, but also railway crossings and in the case of grooved rails.

BACKGROUND OF THE INVENTION

Machining rails for laid railway or underground railway rails or streetcar rails is fundamentally known, as mentioned, for example, in patent EP 0952255 A1.

In general, the goals are defined in the case of all rail machining so that maximum removal of the flaws or cracks is to be achieved, depending on the rail state, simultaneously with the least possible material removal, and also with the best possible surface quality or dimensional accuracy with respect to the longitudinal and/or transverse profile. Grinding applications are encountered in this case more in the field of the lesser removal performance, and milling is encountered more in the field of the greater feed depths. Furthermore, planing applications are known for reprofiling rails.

The requirements with respect to the machining accuracy and surface quality are becoming greater and greater in particular under the aspect of low noise generation of the traveling train as a result of the rolling noise, which is to be minimized. These represent expanded and novel demands for the machining methods, particularly in regard to the rail tracking of the machining tools, to achieve the above-mentioned requirements.

Multiple proposed solutions for exact tracking of the machining tools are known in the prior art, which can be divided into two subgroups in principle. On the one hand, fixed or adjustable guide elements, which track or adjust the machining tools in a force-guided manner, are used, as mentioned, for example, in patents AT 366437 and DE 3015230 A1. On the other hand, the rail position is determined via suitable measuring means, for example, feeler elements or contactless measuring elements, and the machining tools are readjusted accordingly, as described in patents DD 283850 and EP 0552473 A1. To pass rail regions having rail gaps, for example, in the case of shunts in the region of the frog point and, in the case of intersections, in the region of the single and double frog points, multiple proposed solutions are also known in the prior art, for example, the automatically controlled raising of the machining tools by feelers located on the inside and outside in relation to the rail, as in patent DD 275837 A5, or changing to lateral copying on the opposing rail of the track strand or changing to a lateral copying unit on the outside region of the rail to be machined as mentioned in patent AT 510566 B1.

So as not to lose the precise position of the machining tools in relation to the respective rail, an assignment to the rail inner edge of the respective rail to be machined is sought. In particular so that no quality losses have to arise with respect to the precision of the machining result, it is important to refer to a rail strand, since the rail head width varies due to the production tolerances of the rail and this results in errors during a scan of inside and outside.

Furthermore, during a change of the two rails, the differing track width, which is also subject to tolerances, is to be considered as an error source. These deviations can be up to several millimeters in each case and are not acceptable.

The machining of the rail is to be performed aligned according to the defining inner edge or the affected track channel of the rail.

In addition, no automatic option is known from the prior art, which identifies the end of a rail interruption, and it is always the task of the operator to engage the machining and/or analysis tools again.

On the one hand, this requires a high level of attentiveness of the personnel, but also a relatively large non-machined region, since, for safety reasons, the machining can only be begun again after reliably leaving the rail interruption.

Accordingly, it is therefore desirable to overcome the described disadvantages of the existing systems and to solve the problems connected thereto in rail machining and/or rail analysis and to provide a method and a device which enable optimum rail machining and/or rail analysis-by way of regulated tracking of the respected device by means of controlled lateral copying unit or controlled lateral copying units, in particular by timely recognition of the rail gaps and reliable readjustment after completed passage of the rail gaps, by incorporating the check rails and wing rails or tongue rails of the respective track channel in the control.

SUMMARY OF THE INVENTION

In the system described herein, at least one lateral copying element, as is known in principle in the prior art, per rail strand is arranged in each case on the inner side of the respective rail. The lateral copying elements are associated with the rail lateral faces or geometry subregions of the rail inner side and control the respective device unit assigned to the rail independently of one another. In this case, as is also known in the prior art, the feeler or sensor can be fixedly connected to the device unit. In practice, however, measuring the travel distances of the feelers or sensors has proven to be more reasonable, since slight irregularities are easier to process in program technology and tracking the device unit can be easily suppressed if it is not desired or reasonable.

Furthermore, position detection and tracking is possible via contactless systems, for example, optical detection by means of camera, laser, or also capacitive or inductive pickups. Due to the structural size of larger device units, it is also furthermore known that as a result of constricted space conditions or interfering geometries, for example, when ascertaining the rail position, both lateral copying units can simultaneously have influence on both machining assemblies in dependence on one another in program technology.

For better comprehensibility, the following statements only refer to one rail strand and the associated track channel. The device of the opposing rail strand carries out similar or different sequences independently from the first rail strand as required, wherein, for example, at the point in time of placement on the rails to ascertain the rail position, a program-technology coupling of both device units of both rail strands can be performed.

Since, during passage over a rail gap, an excessively strongly deflected measurement result is relayed to the controller, and also, when traveling further in the deflected position of the lateral copy, damage to the mechanism of the lateral copying unit can occur upon reaching an interfering edge, for example, the frog tip or also a rail butt joint edge, as well as distortions of the machining in the transverse profile on the rail machining, timely recognition of the rail interruption, the shunt, or the intersection and also reliable resetting after completed travel over the rail gap are necessary.

The system described herein expands the above-described lateral copying elements by incorporating the further items of information from the track channel in the controller. These items of information can be used by the check rail, a wing rail or tongue rail, but also in railway crossings or in the case of grooved rails for more exact positioning of device units. In this case, predominantly in each case only the items of information are obtained from the associated track channel of the rail to be machined and/or analyzed. Furthermore, the method according to the system described herein, by way of the items of information of the track channel, can also automatically identify the beginning of a shunt by recognizing the tongue region, due to the tongue rail or rail tongue, referred to hereafter as the tongue rail for the sake of simplicity, which is located at a distance to the travel rail.

This can be applied in multiple preferred embodiment variants, on the basis of which the system described herein will be described in greater detail.

BRIEF DESCRIPTION OF THE DRAWINGS

Embodiments of the system described herein will be further explained in more detail below with reference to the attached drawings.

DETAILED DESCRIPTION OF VARIOUS EMBODIMENTS

For better comprehensibility, lateral copying elements (20) are referred to.

These are understood to include, on the one hand, feeler elements, but also contactless sensors, which relay the position information in a mechanically coupled or electronic manner to a machining tool, an application device, an analysis device, or a controller.

The application and the retraction of these elements can be performed in a spring-loaded manner, or also pneumatically, hydraulically, or by a servo motor, or also the various variants can be combined. For example, the contact pressure can be produced in a spring-loaded manner, the retraction can be performed by servo motor, or these can be performed in other arbitrary combinations.

In the case of feeler elements, these can be embodied as rollers, levers, or sliding elements.

The respective position of the lateral copying element (20) is visible in the y direction in relation to the rail (10). A deviation results from a movement in the y direction during a defined advance of the rail vehicle, which lies outside a specific region of a possible rail curve. If this deviation in the y direction is located beyond a specific distance to be defined, this is referred to as the predefined engagement limit, which can trigger a reaction.

The lateral copying unit is used by the device unit for exact positioning in relation to the rail (10).

This device unit can be an analysis unit for quality determination of the rail (10), in particular a camera for image capture, a sensor for detecting cracks, and also a sensor for determining the surface roughness and/or waviness.

The device unit can also be a material application unit. Material application is understood to include, for example, welding devices, but also other material application devices.

Furthermore, the device unit can be a material removal device. Machining methods such as grinding, milling, and planing are to be mentioned for material removal here.

Of course, multiple different or similar device units can also be installed on one rail vehicle.

Figure 1:
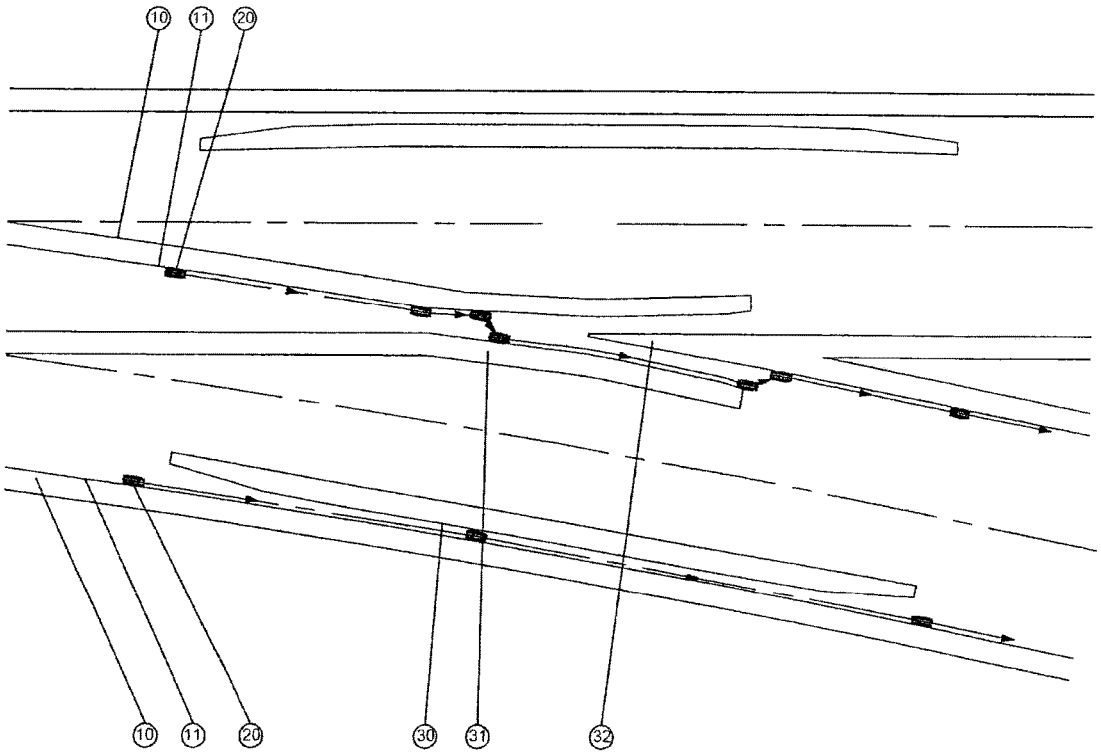
FIG. 1 shows a schematic arrangement of the copying elements during a shunt passage according to embodiments of the system described herein.
Figure 2:
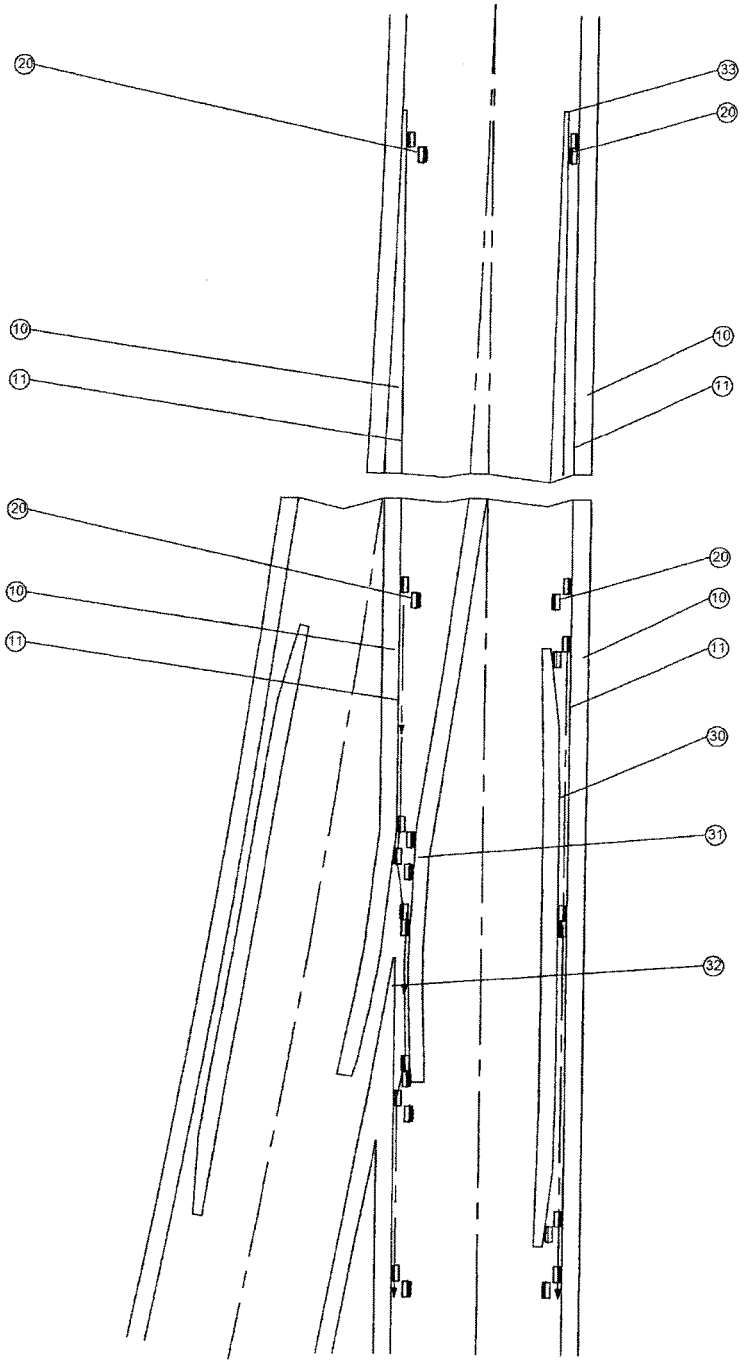
FIG. 2 shows a schematic arrangement of the copying elements during a shunt passage according to alternative embodiments of the system described herein.
Figure 4:
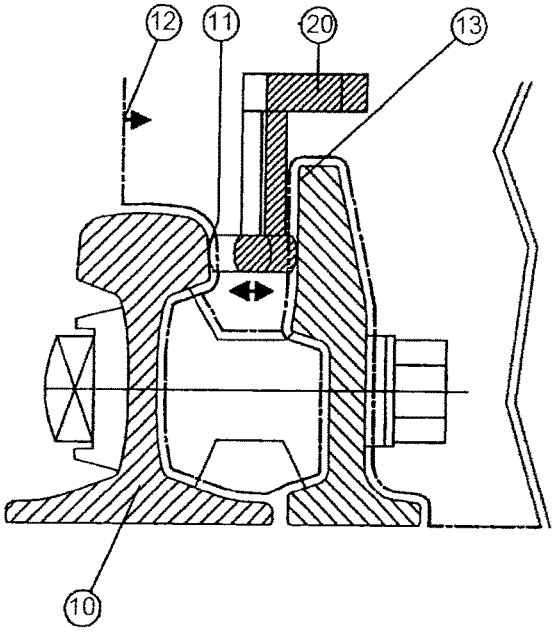
FIG. 4 shows a schematic side view of a rail head and a check rail, wherein the copying element is applied to the check rail according to embodiments of the system described herein.
Figure 3:
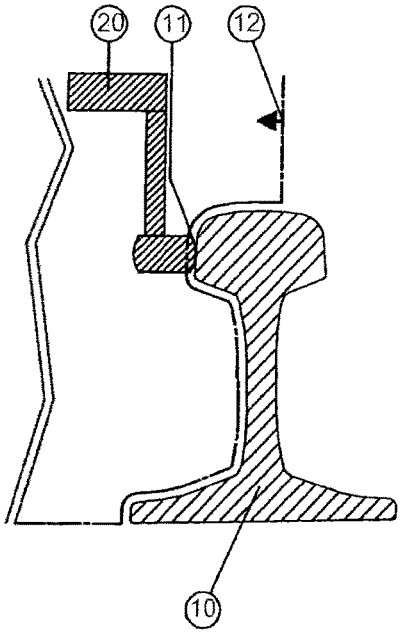
FIG. 3 shows a schematic side view of a rail head having an applied copying element and illustration of the y axis according to embodiments of the system described herein.

The structural space from the rail lateral contour in the direction of the track center is to be considered as the track channel (12). This track channel (12) is apparent in particular in FIGS. 3 and 4.

In the region of an undisturbed rail profile (10), this is significant only in the case of streetcar rails, i.e., mostly in the case of grooved rails. In the case of railway or underground railway rails, this track channel (12), which extends in a width of up to 150 mm from the rail (10) to the track center, is of interest at shunts and intersections, and also at railway crossings, since here in addition, due to occurring wing rails or tongue rails (31, 33), check rails (30), and other structural elements, items of information can be found about the track status.

In a first embodiment variant according to the system described herein, the lateral copying element (20) is embodied in the direction of the rail inner edge (11) so that both the inner side of the rail (10) to be machined and also the inner side of the track channel (12) of the check rail side (30) or wing rail side (31) associated with the rail (10), i.e., in the direction of the track center, can be scanned. If, during the passage of the rail strand (10), increased deviation occurs (reaching a defined engagement limit), this is to be attributed to an irregularity in the rail strand (10). The lateral copying unit (20) will thus result in an increased measurement deflection at a rail gap and subsequently will be deflected in the opposite direction toward the track center, so that it comes into contact on the check rail side (30) or wing rail side (31). The lateral copying unit (20) is thus protected from the next occurring interfering point, for example, the frog tip (32).

If there is no contact of the lateral copying unit (20) and the lateral copying unit (20) is deflected up to a defined end position in the direction of the track center, in this case, during the passage over the rail gap, there is not a track channel crossing as in the case of the frog (20) of a shunt or, for example, in the case of a single frog (32) or double frog of an intersection, but rather a travel over a rail butt joint gap, because of not reaching a starting contour. By absorbing an advance movement of the rail vehicle of at least 50 mm, which is already covered in the normal case by the reaction time and movement time, the lateral copying unit (20) can again be applied to the rail (10).

Upon reaching a wing rail (31) or check rail (30), the lateral copying unit (20) remains on the track channel inner side (30) in each case up to a predefined engagement limit. If the second engagement limit is reached, i.e., if the lateral copying unit moves further toward the track center at the end of the wing rail (31), the rail interruption was successfully passed and therefore the lateral copying unit (20) can again be securely applied to the inner side of the rail (11). If, in the case of a double frog, this position of the maximum deflection in the direction toward the track center in relation to a defined travel distance, which results via the track width and the intersection inclination, should occur a second time, the double frog region was just passed. The lateral copying unit (20) has plunged into the track region of the opposing track. A reset can also be performed again. This is represented by a further switchover. The lateral copying unit (20) now again presses against the inner side of the rail (11) to be machined.

During this passage, the device can again be in the engagement position, i.e., in function, or in a retracted position without engagement with the rail (10).

Since, for example, in common rail systems in the European region, the track channel (12) in the case of check rails (30) with normal track is specified as 38 mm, a structural embodiment of a mechanical lateral copying sliding element (20) having the required lateral play at a maximum width of approximately 30 mm is to be considered reasonable. This sliding element (20) can be used in each case separately or in one piece for contact on the rail inner side (11) and the track channel inner side of the check rail (13) or the wing rail (31). Furthermore, the copying element (20) can also be embodied as a roller.

In a second embodiment variant according to the system described herein, the lateral copying element (20) is embodied so that the application to the rail head inner side (11) and the application to the inner side of the track channel (12) of the check rail (30) or the wing rail or tongue rail (31, 33) is represented by two feeler elements (20), which are separate from one another or combined. Altered behavior thus results in that due to the applied feeler element (20) in the direction of the check rail (30) or the wing rail (31), before reaching the rail interruption in the region of the frog (30) or in the region of the double frog, a deflection movement of the feeler element (20) already occurs at the beginning due to the intake region of the check rail (30) or the wing rail (31), but also upon reaching a tongue rail (33). The inner feeler (20), which is without function in the undisturbed rail profile (10), is deflected in the direction of the associated rail inner edge (11). The passage of, for example, a check rail (30) or a wing rail or tongue rail (31, 33) is thus to be expected.

The measurement results between check rail (30) or wing rail or tongue rail (31, 33) and rail inner side (11) can be observed and evaluated in precise dimensions. Already, or at latest upon a drift of the rail inner side (11), a movement away of the lateral copying unit (20) of the rail inner side (11) can be the immediate reaction. If no rail interruption occurs with applied wing rail or tongue rail or check rail scanning (30, 31, 33), i.e., the lateral inner copying unit of the rail (10) does not change its position, it is solely a check rail arrangement (30) or tongue rail region (33) or a railway crossing with continuous rail (10). If a tongue rail (33) is recognized because of the dimensional change of the contour and the opposing rail strand side which remains free, influence can be taken on the feed or reset of the machining tools or device. If this is not the case, no further reaction is necessary.

If the feeler element (20) on the check rail (30) or on the wing rail (31) is again deflected up to a predefined amount in the direction of the track center, the frog region (32) has been reliably left again and the lateral copying unit (20) can again be applied to the inner side (11) of the rail (10) to be machined.

In addition, in this case this can also relate to a double frog region. For safety, the lateral copying unit (20) on the check rail (30) or the wing rail (31) is therefore moved into a spaced-apart retracted position and only applied again after a travel distance of the rail vehicle of approximately 500 mm. To enlarge the structural size of the lateral copying unit (20) as already mentioned above, the feeler elements (20) can be arranged diagonally both on the rail (10) and also on the check rail (30) or wing rail or tongue rail (31, 33) and can also scan or record a transition region between lateral surface and radius of the rail head profile. In this embodiment region, the feeler elements (20) only have a sliding region and can retract into a secured retracted position in the event of rail gaps. In the retracted state, the respective applied feeler (20) takes over the control by the determined measurement results.

Furthermore, the lateral scanning of both the inner side of the rail (11) and also the inner side of the track channel (12) on the wing rail or tongue rail side (31, 33) and on the check rail side (30) can be supplemented such that the control of the retraction movements is assumed via a sensor or feeler which observes in the travel direction, and which is vertically arranged and can establish a rail interruption from above.

It is accordingly possible in a similar embodiment of the system described herein that both regions, i.e., the rail inner edge (11), and also the inner edge of additional installations in the track channel (12) (wing or tongue rails (31, 33), check rail (30), railway crossings) are to be detected by a double-action lateral copying element (20), which is variable in the width. Such an element (20) can scan or optically capture both sides simultaneously and is variable in its width. The variable width has the result that, for example, in the case of a check rail (30), the first engagement takes place in the conical intake zone, subsequently the width decreases according to the track channel width, and the width increases again at the conical outlet.

These first two methods or devices are suitable in particular in the present prior art with respect to the shunt or intersection machining, since the frog regions (32), for example, according to DB guideline RIL 824.4016, are excluded from machining by drivable rail machining machines and timely recognition of these regions can be automatically used for initiating suitable travel movements of the machining tools. Furthermore, however, using the two above-described methods, the passage of the frog regions (32) with a rail vehicle having devices for rail machining and/or analysis can be implemented such that the rail actual position in relation to the slightly retracted devices is furthermore known and also immediate further use after the critical region can also be automatically recognized and initiated again. New placement on the rails of the device units with a new rail search is therefore not necessary. Furthermore, due to the method according to the system described herein, a change to an outer side of the rail (10) external to the track channel or to the opposite rail (10) does not have to be performed. Furthermore, however, a tongue region (33) of a shunt can also be automatically recognized and corresponding measures can be initiated at the device.

In a further embodiment variant according to the system described herein, the already-described method is expanded in that an approximated position in relation to the rail (10) can also be represented in the region of rail interruptions, in particular in the case of frogs (32). This is achieved according to the system described herein in that at least two lateral copying elements (20) are embodied successively in relation to the same rail (10). Upon entering a shunt or intersection, the elements of two lateral copying units are applied to the same rail inner edge (11). The copying elements (20) can again be embodied in this case as described at the beginning. The locations of the feeler elements (20) in the y direction are determined based on the actual positions and continuously compared. The plunging into a rail gap can be established via a predefined engagement window. This engagement window results from a corresponding deviation of they position during a defined advance. Furthermore, the above-described vertically arranged sensors or feelers can also additionally be used here for recognizing the rail gaps. The successively arranged lateral copying elements are arranged at a distance to one another so that a maximum gap can be passed without problems and without loss of the rail inner edge (11). If a feeler (20) is located in the position of a rail gap, the control of the device is switched over to the further feeler (20) still remaining on the rail inner edge (11). Only when the first copying element (20) has been reset back to the rail inner edge (11) will the measuring signal again be used thereof for the controller. Due to a detection of the frog tip (32) by the described additional feelers or sensors, a reset of the first lateral copying unit (20) can be performed early. The distance of the successively arranged lateral copying elements (20) can thus be selected to be slightly greater than the maximum occurring gap distance. This gap distance is generally at most 1600 mm.

In a further preferred embodiment variant of the method according to the system described herein, three or more lateral copying elements (20) per rail strand (10) are arranged successively and in relation to the same rail inner edge (11). The embodiment and the sequence are embodied as in the above-described variants, wherein the lateral copying unit (20) which carries out the actual position control of the device unit has at least one lateral copying unit (20) connected upstream and at least one further lateral copying unit (20) connected downstream. Due to this arrangement, the tracking movement and precisions can be improved such that the rail gap can also be passed in the engagement position of the device unit. In this case, the required information can always be supplied by an inner copying element (20) applied to the rail (10).

Of course, it is also possible to combine the described embodiment variants in a rail vehicle, which can also have multiple device units, of course, with different variants of the lateral copying unit.

Furthermore, only one or multiple device units can also be equipped with the lateral copying unit (20) according to the system described herein and other device units installed on the vehicle can be controlled via known systems.

It is furthermore possible to use so-called track channel clearing units in the travel direction in front of the lateral copying units and/or the device units, which remove or at least detect unpredicted foreign bodies which are not part of the track system.

It is therefore possible using the system described herein to ensure optimum rail tracking of device units, and therefore optimum rail monitoring and maintenance, also over regions having rail gaps.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A method for tracking a device unit for analysis, material removal or material application installed on a rail vehicle to detect irregularities in a laid rail, comprising:

providing at least one copying element that controls a position of the device unit;

the copying element ascertaining a position of an inner side of a rail head in response to a measurement deviation being below a first predefined engagement limit;

the copying element ascertaining a position of an inner side of rail components within a track channel in a direction of a track center in response to the measurement deviation reaching the first predefined engagement limit; and following ascertaining the position of the inner side of the rail components, the copying element ascertaining the position of the inner side of the rail head in response to the measurement deviation reaching a second predefined engagement limit that is different than the first predefined engagement limit.

2. The method according to claim 1, wherein at least one copying element is used, which can supply items of geometry information from both sides of the track channel.

3. The method according to claim 1, wherein at least two copying elements that are arranged in pairs scan the inner edge of the rail head and also an inner edge of an occurring check rail or a wing rail or tongue rail.

4. The method according to claim 1, wherein at least one copying element is used, which can simultaneously supply items of geometry information from both sides of the track channel.

5. The method according to claim 1, wherein at least two successively arranged copying elements each scan the inner edge of the rail.

6. The method according to claim 1, wherein in each case at least one copying element is arranged in front of and at least one other copying element is arranged after the device unit viewed in an advance direction.

7. The method according to claim 1, wherein the device unit is embodied as a material removing unit.

8. The method according to claim 1, wherein the device unit is embodied as a material applying unit.

9. The method according to claim 1, wherein the device unit is embodied as an analysis unit.

10. A device for detecting irregularities in a laid rail, comprising:

at least one device unit for analysis, material removal or material application which is installed on a rail vehicle that travels on the rail; and at least one copying element that controls a position of the device unit, the copying element ascertaining a position of an inner side of a rail head in response to a measurement deviation being below a first predefined engagement limit, ascertaining a position of an inner side of rail components within a track channel in a direction of a track center in response to the measurement deviation reaching the first predefined engagement limit, and, following ascertaining the position of the inner side of the rail components, the copying element ascertaining the position of the inner side of the rail head in response to the measurement deviation reaching a second predefined engagement limit that is different than the first predefined engagement limit.

11. The device according to at least one of claims claim 10, wherein at least one copying element supplies items of geometry information on both sides of the track channel.

12. The device according to claim 10, wherein at least two copying elements that are arranged in pair scan both the inner edge of the rail head, and also an inner edge of an occurring check rail or a wing rail or tongue rail.

13. The device according to claim 10, wherein at least one copying element supplies items of geometry information simultaneously from both sides of the track channel.

14. The device according to claim 10, wherein at least two successively arranged copying elements each scan the inner edge of the rail.

15. The device according to claim 10, wherein at least one copying element—is arranged in front of and at least one additional copying element is arranged after the device viewed in an advance direction.

16. The device according to claim 10, wherein the device is embodied as a material removing unit.

17. The device according to claim 10, wherein the device is embodied as a material applying unit.

18. The device according to claim 10, wherein the device is embodied as an analysis unit.

19. The device according to claim 10, wherein at least two copying elements have at least one scanning position and at least one idle position.

20. The device according to claim 10, wherein at least two copying elements have a distance to one another depending on a maximum rail gap distance and in dependence on a predetermined number.

21. The device according to claim 10, wherein the at least one copying element is embodied in a scanning manner as at least one of: rollers or levers or sliding elements.

22. The device according to claim 10, wherein the at least one copying element is implemented using contactless sensors.

23. The device according to claim 10, wherein the at least one copying element is implemented using additional vertical sensors.

24. The device according to claim 10, wherein the at least one copying element is implemented using additional track channel clearing units connected upstream in an advance direction.

* * * * *